US009235150B2

(12) United States Patent
Koyama

(10) Patent No.: US 9,235,150 B2
(45) Date of Patent: Jan. 12, 2016

(54) MAGNETIC ONE-COMPONENT DEVELOPING TONER

(71) Applicant: KYOCERA DOCUMENT SOLUTIONS INC., Osaka (JP)

(72) Inventor: Akinori Koyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 55 days.

(21) Appl. No.: 14/213,803

(22) Filed: Mar. 14, 2014

(65) Prior Publication Data

US 2014/0272700 A1 Sep. 18, 2014

(30) Foreign Application Priority Data

Mar. 15, 2013 (JP) ..... 2013-053526

(51) Int. Cl.
*G03G 9/08* (2006.01)
*G03G 9/083* (2006.01)
*G03G 9/087* (2006.01)

(52) U.S. Cl.
CPC ..... *G03G 9/0833* (2013.01); *G03G 9/0836* (2013.01); *G03G 9/0837* (2013.01); *G03G 9/08755* (2013.01); *G03G 9/08795* (2013.01); *G03G 9/08797* (2013.01)

(58) Field of Classification Search
CPC ..... G03G 9/08755; G03G 9/0836; G03G 9/08797
USPC ..... 430/109.4, 106.1, 111.4
See application file for complete search history.

(56) References Cited

U.S. PATENT DOCUMENTS

2009/0311617 A1 12/2009 Uemoto et al.
2011/0045398 A1* 2/2011 Sekikawa et al. ..... 430/108.22

FOREIGN PATENT DOCUMENTS

JP 2010-024445 A 2/2010

* cited by examiner

*Primary Examiner* — Mark A Chapman
(74) *Attorney, Agent, or Firm* — Studebaker & Brackett PC

(57) ABSTRACT

A magnetic one-component developing toner including a plurality of toner particles is provided. Each of the plurality of toner particles contains a binder resin including a polyester resin; and a magnetic powder. Water absorptions of the toner and the magnetic powder shown in an environment of 10° C. and 20% RH and in an environment of 28° C. and 80% RH respectively fall in predetermined ranges.

6 Claims, 1 Drawing Sheet

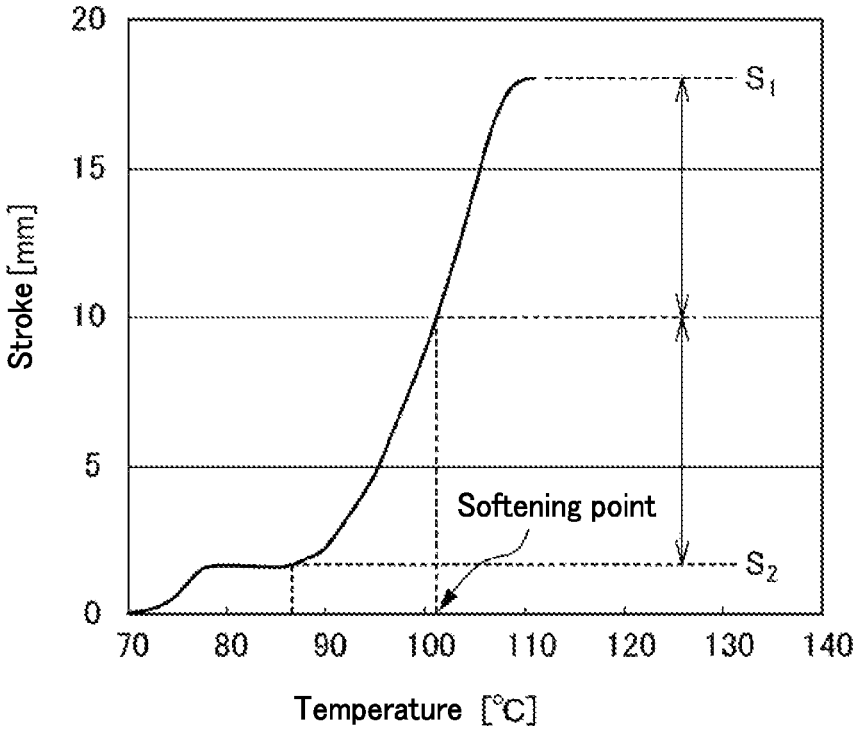
20
15
10
5
0
Stroke [mm]
70
80
90
100
110
120
130
140
Temperature [°C]
S1
S2
Softening point

MAGNETIC ONE-COMPONENT DEVELOPING TONER

INCORPORATION BY REFERENCE

The present application claims priority under 35 U.S.C. §119 to Japanese Patent Application No. 2013-053526, filed on Mar. 15, 2013. The contents of this application are incorporated herein by reference in their entirety.

BACKGROUND

The present disclosure relates to a magnetic one-component developing toner.

As dry developing methods currently practically employed in electrophotography, two-component development and magnetic one-component development are known. In the two-component development, a toner and a carrier are used. In the magnetic one-component development, a carrier is not used but a toner containing a magnetic powder is used. The toner containing a magnetic powder (hereinafter sometimes referred to as the magnetic toner) used in the magnetic one-component development has advantages of low cost and excellent durability. In such a magnetic toner, a polyester resin is often used as a binder resin because a coloring agent or a magnetic powder can be satisfactorily dispersed in the toner and the toner can easily attain excellent low-temperature fixability when the polyester resin is used as a binder resin.

If an image is formed by using a magnetic toner containing a polyester resin as a binder resin in a high-temperature and high-humidity environment, however, the image density of the formed image is liable to be lower than a desired value due to degradation of the charge amount of the toner.

In order to solve this problem, a particle powder of black magnetic iron oxide having an average particle size of 0.05 μm or more and 2.0 μm or less and an electrical resistance value of $1\times10^8$ Ω·cm or more under an applied voltage of 100 V has been proposed. If a magnetic toner containing such a particle powder of black magnetic iron oxide as a magnetic powder is used, an image can be formed in a desired image density even in a high-temperature and high-humidity environment.

SUMMARY

The present disclosure relates to a magnetic one-component developing toner including a plurality of toner particles.

Each of the plurality of toner particles contains a binder resin and a magnetic powder.

The binder resin includes a polyester resin.

A mass of the toner measured after standing in a desiccator together with a desiccant in an environment of 25° C. for 48 hours is indicated as $WT_I$. A mass of the toner, having been measured for the mass $WT_I$, measured after standing in an environment of 10° C. and 20% RH for 48 hours is indicated as $WT_L$. A mass of the toner, having been measured for the mass $WT_I$, measured after standing in an environment of 28° C. and 80% RH for 48 hours is indicated as $WT_H$. In this case, a water absorption $AT_L$ of the toner obtained in accordance with the following formula (1) is 0.07% by mass or less, and a water absorption $AT_H$ of the toner obtained in accordance with the following formula (2) is 0.27% by mass or more and 0.34% by mass or less:

$$AT_L=((WT_L-WT_I)/WT_I)\times100 \quad (1)$$

$$AT_H=((WT_H-WT_I)/WT_I)\times100 \quad (2)$$

A mass of the magnetic powder measured after standing in a desiccator together with a desiccant in an environment of 25° C. for 48 hours is indicated as $WM_I$. A mass of the magnetic powder, having been measured for the mass $WM_I$, measured after standing in an environment of 10° C. and 20% RH for 48 hours is indicated as $WM_L$. A mass of the magnetic powder, having been measured for the mass $WM_I$, measured after standing in an environment of 28° C. and 80% RH for 48 hours is indicated as $WM_H$. In this case, a water absorption $AM_L$ of the magnetic powder obtained in accordance with the following formula (3) is 0.08% by mass or more, and a water absorption $AM_H$ of the magnetic powder obtained in accordance with the following formula (4) is 0.25% by mass or less:

$$AM_L=((WM_L-WM_I)/WM_I)\times100 \quad (3)$$

$$AM_H=((WM_H-WM_I)/WM_I)\times100 \quad (4)$$

BRIEF DESCRIPTION OF THE DRAWINGS

FIG. 1 is an explanatory diagram illustrating a method for measuring a softening point by using an elevated flow tester.

DETAILED DESCRIPTION

An embodiment of the present disclosure will now be described in detail. The present disclosure is not limited to the following embodiment but may be practiced with appropriate modification made within the scope of the object of the present disclosure. Incidentally, description will be appropriately omitted for avoiding redundant description, which does not limit the spirit of the disclosure.

A magnetic one-component developing toner (hereinafter sometimes simply referred to as the toner) of the present disclosure includes a plurality of toner particles. Each of the toner particles contains a binder resin and a magnetic powder. The toner of the present disclosure has a water absorption $AT_L$ (i.e., a water absorption shown after standing in an environment of 10° C. and 20% RH for 48 hours) and a water absorption $AT_H$ (i.e., a water absorption shown after standing in an environment of 28° C. and 80% RH for 48 hours) respectively falling in predetermined ranges. The magnetic powder has a water absorption $AM_L$ (i.e., a water absorption shown after standing in an environment of 10° C. and 20% RH for 48 hours) and a water absorption $AM_H$ (i.e., a water absorption shown after standing in an environment of 28° C. and 80% RH for 48 hours) respectively falling in predetermined ranges. Now, the water absorptions ($AT_L$ and $AT_H$) of the toner and materials contained in the toner will be described.

[Water Absorptions ($AT_L$ and $AT_H$) of Toner]

The toner of the present disclosure has the following characteristics relating to the water absorption. In the following description, a water absorption $AT_L$ corresponds to a water absorption of the toner shown under low-temperature and low-humidity conditions, and a water absorption $AT_H$ corresponds to a water absorption of the toner shown under high-temperature and high-humidity conditions.

A mass of the toner measured after standing in a desiccator together with a desiccant in an environment of 25° C. for 48 hours is indicated as $WT_I$. A mass of the toner, having been measured for the mass $WT_I$, measured after standing in an environment of 10° C. and 20% RH for 48 hours is indicated as $WT_L$. A mass of the toner, having been measured for the mass $WT_I$, measured after standing in an environment of 28° C. and 80% RH for 48 hours is indicated as $WT_H$. In this case, a water absorption $AT_L$ of the toner obtained in accordance with the following formula (1) is 0.07% by mass or less, and a water absorption $AT_H$ of the toner obtained in accordance with the following formula (2) is 0.27% by mass or more and 0.34% by mass or less:

$$AT_L=((WT_L-WT_I)/WT_I)\times 100 \quad (1)$$

$$AT_H=((WT_H-WT_I)/WT_I)\times 100 \quad (2)$$

If the toner has the water absorption $AT_L$ and the water absorption $AT_H$ respectively falling in the above-described ranges, the toner has excellent fixability, can form an image having a desired image density in both a low-temperature and low-humidity environment and a high-temperature and high-humidity environment, and can suppress occurrence of an image defect (such as fogging) in a formed image.

Preferable examples of the desiccant used in measuring the water absorption $AT_I$ include silica gel, anhydrous calcium sulfate, magnesium oxide, calcium oxide, anhydrous calcium chloride, anhydrous zinc chloride and anhydrous copper sulfate. Silica gel is more preferably used as the desiccant because it is easily handled.

The toner having the water absorption $AT_L$ and the water absorption $AT_H$ respectively falling in the predetermined ranges has a high hydrophilic property to some extent. The toner thus having a high hydrophilic property has high affinity with a recording medium having a large number of hydroxyl groups (such as paper). Therefore, the toner having the water absorption $AT_L$ and the water absorption $AT_H$ within the predetermined range shows excellent fixability on a recording medium. Besides, the toner having the water absorption $AT_L$ and the water absorption $AT_H$ within the predetermined ranges is easily and stably charged to a desired charge amount in both a low-temperature and low-humidity environment and a high-temperature and high-humidity environment. Therefore, when the toner having the water absorption $AT_L$ and the water absorption $AT_H$ respectively falling in the predetermined ranges is used, an image can be formed in a desired image density and occurrence of an image defect (such as fogging) can be suppressed in a formed image in both a low-temperature and low-humidity environment and a high-temperature and high-humidity environment.

The water absorption of the toner can be adjusted by adjusting the acid value or the hydroxyl value of a polyester resin described below used as the binder resin, or by adjusting the water absorption or the content of the magnetic powder described later. Alternatively, the water absorption of the toner can be adjusted by adding, to the toner, an absorbent material (such as polyvinyl alcohol or sodium polyacrylate).

[Toner Materials]

The toner of the present disclosure includes a plurality of toner particles each containing at least a binder resin and a magnetic powder. The binder resin includes a polyester resin. The toner of the present disclosure may contain, in addition to the binder resin and the magnetic powder, an optional component (such as a release agent, a coloring agent or a charge control agent) if necessary. Each toner particle may contain, if necessary, an external additive adhered to its surface. Now, the indispensable components (i.e., the binder resin and the magnetic powder) and optional components (i.e., a release agent, a coloring agent, a charge control agent and an external additive) of the toner of the present disclosure, and a method for producing the magnetic one-component developing toner will be successively described.

[Binder Resin]

The binder resin contained in the toner of the present disclosure indispensably contains a polyester resin. If a polyester resin is contained as the binder resin, a toner showing satisfactory fixability at a low temperature and showing an excellent color developing property can be easily prepared. A polyester resin used as the binder resin may be appropriately selected from polyester resins generally used as binder resins for toners. The polyester resin can be obtained by condensation polymerization or co-condensation polymerization of an alcohol component and a carboxylic acid component. Examples of components used in synthesizing the polyester resin include the following bivalent, trivalent or higher-valent alcohol components and bivalent, trivalent or higher-valent carboxylic acid components.

Specific examples of the bivalent, trivalent or higher-valent alcohol components include diols (such as ethylene glycol, diethylene glycol, triethylene glycol, 1,2-propylene glycol, 1,3-proypylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol), bisphenols (such as bisphenol A, hydrogenated bisphenol A, polyoxyethylene bisphenol A, and polyoxypropylene bisphenol A), and trivalent or higher-valent alcohols (such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene).

Specific examples of the bivalent, trivalent or higher-valent carboxylic acid components include bivalent carboxylic acids (such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl- or alkenyl-succinic acid (such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid)), and trivalent or higher-valent carboxylic acids (such as 1,2,4-benzenetricarboxylic acid (trimellitic acid), 1,2,5-benzenetricarboxylic acid, 2,5,7-naphthalenetricarboxylic acid, 1,2,4-naphthalenetricarboxyic acid, 1,2,4-butanetricarboxylic acid, 1,2,5-hexanetricarboxylic acid, 1,3-dicarboxyl-2-methyl-2-metheylenecarboxy propane, 1,2,4-cyclohexanetricarboxylic acid, tetra(methylenecarboxyl)methane, 1,2,7,8-octanetetracarboxylic acid, pyromellitic acid and Empol trimer acid). The bivalent, trivalent or higher-valent carboxylic acid component may be used in the form of an ester-forming derivative (such as an acid halide, an acid anhydride or a lower alkyl ester). Here, a "lower alkyl" means an alkyl group having 1 to 6 carbon atoms.

The acid value of the polyester resin is preferably 10 mgKOH/g or more and 16 mgKOH/g or less. If the acid value of the polyester resin is too low or too high, a toner having the water absorption $AT_H$ and the water absorption $AT_L$ both falling in the predetermined ranges is difficult to obtain. The hydroxyl value of the polyester resin is preferably 10 mgKOH/g or more and 90 mgKOH/g or less, and more preferably 30 mgKOH/g or more and 70 mgKOH/g or less. If the hydroxyl value of the polyester resin is too low or too high, a toner having the water absorption $AT_H$ and the water absorption $AT_L$ both falling in the predetermined ranges is difficult to obtain.

The acid value and the hydroxyl value of the polyester resin can be adjusted by adjusting balance between a hydroxyl group of an alcohol component and a carboxyl group of a carboxylic acid component used in the synthesis of the polyester resin. Alternatively, the acid value or the hydroxyl value of the polyester resin may be lowered by reacting the polyester resin with a terminal blocking agent (such as an isocyanate compound, a carbodiimide compound or an epoxy compound).

The softening point of the polyester resin is preferably 80° C. or more and 150° C. or less, and more preferably 90° C. or more and 140° C. or less. If the softening point of the polyester resin is too high, the resultant toner is difficult to satisfactorily fix at a low temperature. If the softening point of the polyester resin is too low, the resultant toner may be sometimes aggregated when stored at a high temperature, and hence, the high-temperature storage resistance of the toner may be easily degraded. The softening point of the polyester resin can be measured as follows:

<Method for Measuring Softening Point>

The softening point of the polyester resin is measured by using an elevated flow tester (CFT-500D (manufactured by Shimadzu Corporation)). Specifically, the measurement of the softening point of the polyester resin is performed as follows: The polyester resin in an amount of 1.5 g is used as a sample, and a die having a height of 1.0 mm and a diameter of 1.0 mm is used. The measurement is performed under conditions of a temperature increasing rate of 4° C./min, preheating time of 300 seconds, a load of 5 kg and a measurement temperature range from 60° C. to 200° C. inclusive. On the basis of an S shaped curve pertaining to a temperature (° C.) and a stroke (mm) obtained in the measurement of the polyester resin by the flow tester, the softening point of the polyester resin is read.

A method for reading the softening point will be described with reference to FIG. 1. The maximum value of the stroke is indicated as $S_1$, and a stroke value corresponding to a low-temperature-side base line is indicated as $S_2$. On the S shaped curve, a temperature corresponding to a stroke value of $(S_1+S_2)/2$ is regarded as the softening point of the polyester resin.

The glass transition point (Tg) of the polyester resin is preferably 50° C. or more and 65° C. or less, and more preferably 50° C. or more and 60° C. or less. If the glass transition point of the polyester resin is too low, the strength of the polyester resin is lowered and hence the resultant toner is easily adhered to a latent image carrying section. If the glass transition point of the polyester resin is too high, there is a tendency that the resultant toner is difficult to satisfactorily fix at a low temperature.

The glass transition point of the polyester resin can be obtained on the basis of a change point of specific heat of the polyester resin by using a differential scanning calorimeter (DSC) in accordance with JIS K7121. More specifically, the glass transition point can be obtained by measuring a heat absorption curve of the polyester resin by using a differential scanning calorimeter (such as "DSC-6200" manufactured by Seiko Instruments Inc.) as a measurement apparatus as follows: Ten mg of a measurement sample is put in an aluminum pan, and an empty aluminum pan is used as a reference. A heat absorption curve of the polyester resin is obtained through measurement performed under conditions of a measurement temperature range from 25° C. to 200° C. inclusive, a temperature increasing rate of 10° C./min, and room temperature and normal humidity. The glass transition point of the polyester resin can be obtained based on this heat absorption curve.

The number average molecular weight (Mn) of the polyester resin is preferably 2000 or more and 30000 or less. If the number average molecular weight (Mn) of the polyester resin is 2000 or more and 30000 or less, a toner that can be satisfactorily fixed on paper over a wide temperature range can be easily obtained. A molecular weight distribution (Mw/Mn) expressed as a ratio between the number average molecular weight (Mn) and the mass average molecular weight (Mw) is preferably 3 or more and 40 or less. If the molecular weight distribution of the polyester resin is 3 or more and 40 or less, a toner having excellent low-temperature fixability can be easily obtained. The number average molecular weight (Mn) and the mass average molecular weight (Mw) of the polyester resin can be measured by gel permeation chromatography.

The binder resin may contain, apart from the polyester resin, another thermoplastic resin. If the binder resin contains a combination of the polyester resin and a thermoplastic resin other than the polyester resin, this thermoplastic resin other than the polyester resin can be appropriately selected from thermoplastic resins conventionally used as binder resins for toners.

The content of the polyester resin in the binder resin is preferably 70% by mass or more, more preferably 80% by mass or more, particularly preferably 90% by mass or more, and most preferably 100% by mass.

[Magnetic Powder]

Each of the toner particles included in the toner of the present disclosure contains a magnetic powder. The magnetic powder has specific water absorption characteristics described below. In the following description, a water absorption $AM_L$ corresponds to a water absorption of the magnetic powder shown under low-temperature and low-humidity conditions, and a water absorption $AM_H$ corresponds to a water absorption of the magnetic powder shown under high-temperature and high humidity conditions.

A mass of the magnetic powder measured after standing in a desiccator together with a desiccant in an environment of 25° C. for 48 hours is indicated as $WM_I$. A mass of the magnetic powder, having been measured for the mass $WM_I$, measured after standing in an environment of 10° C. and 20% RH for 48 hours is indicated as $WM_L$. A mass of the magnetic powder, having been measured for the mass $WM_I$, measured after standing in an environment of 28° C. and 80% RH for 48 hours is indicated as $WM_H$. In this case, a water absorption $AM_L$ of the magnetic powder obtained in accordance with the following formula (3) is 0.08% by mass or more, and a water absorption $AM_H$ of the magnetic powder obtained in accordance with the following formula (4) is 0.25% by mass or less:

$$AM_L=((WM_L-WM_I)/WM_I)\times 100 \quad (3)$$

$$AM_H=((WM_H-WM_I)/WM_I)\times 100 \quad (4)$$

As the desiccant used in measuring the mass $WM_I$, a desiccant similar to that used in measuring the mass $WT_I$ can be used.

A toner including a toner particle containing the magnetic powder having the water absorption $AM_L$ and the water absorption $AM_H$ respectively falling in the predetermined ranges can be easily stably charged to a desired charge amount in both a low-temperature and low-humidity environment and a high-temperature and high-humidity environment. Therefore, when the toner of the present embodiment including the toner particle containing the magnetic powder having the water absorption $AM_L$ and the water absorption $AM_H$ respectively falling in the predetermined ranges is used, an image can be formed in a desired image density and the occurrence of an image defect (such as fogging) can be suppressed in a formed image in both a low-temperature and low-humidity environment and a high-temperature and high-humidity environment.

The type of magnetic powder is not especially limited as long as the water absorption $AM_L$ and the water absorption $AM_H$ thereof respectively fall in the predetermined ranges. Examples of a suitable material of the magnetic powder include an iron oxide particle (such as ferrite or magnetite), a ferromagnetic metal (such as cobalt or nickel), an alloy containing iron and/or a ferromagnetic metal, a compound containing iron and/or a ferromagnetic metal, a ferromagnetic alloy having been ferromagnetized by heating or the like, and chromium dioxide. Preferable examples of the material of the magnetic powder include ferrite and magnetite. Magnetite is particularly preferably used because the water absorption $AM_L$ and the water absorption $AM_H$ can be easily adjusted in using it.

A method for producing a magnetic powder is not especially limited as long as a magnetic powder having the water absorption $AM_L$ and the water absorption $AM_H$ respectively falling in the predetermined ranges can be prepared. If magnetite particles are used as the magnetic powder, the magnetic powder can be produced by a method described below.

Now, as a specific example of a suitable method for producing a magnetic powder, a method for producing magnetite particles will be described. Incidentally, the method for producing a magnetic powder is not limited to the following method.

(Method for Producing Magnetic Powder)

An alkali aqueous solution is added to and mixed with a ferrous salt aqueous solution. The thus obtained mixture is heated to a temperature of 80° C. or more to give a suspension containing ferrous hydroxide colloid. Thereafter, the obtained suspension is retained at the same temperature for a while. Subsequently, an oxidation reaction is performed by allowing an oxygen-containing gas (such as air) to pass therethrough under addition of an aqueous solution of a non-ferrous oxide (such as silicic acid, titanic acid or phosphoric acid) dissolved in an aqueous medium. In this manner, a slurry containing magnetite particles on surfaces of which the non-ferrous oxide is adhered can be obtained. Subsequently, the magnetite particles are filtered out of the slurry containing the magnetite particles. The filtered magnetite particles are washed and dried, thereby obtaining aggregates of the magnetite particles. The thus obtained aggregates of the magnetite particles are pulverized to give magnetite particles.

The water absorption of the magnetic powder can be adjusted by adjusting the specific surface area of the magnetic powder. Since water is absorbed in a surface portion of the magnetic powder, there is a tendency that the water absorption of the magnetic powder becomes lower as its specific surface area is smaller. If a magnetic powder containing a non-ferrous oxide (such as silicic acid, titanic acid or phosphoric acid) adhered to the surface thereof is used, the water absorption of the magnetic powder can be adjusted by adjusting the amount of the non-ferrous oxide used in producing the magnetic powder. There is a tendency that the water absorption of the magnetic powder becomes larger as the amount of the non-ferrous oxide to be used is larger.

Typically, the particle size of the magnetic powder is preferably 0.1 μm or more and 1.0 μm or less, and more preferably 0.1 μm or more and 0.5 μm or less. If the magnetic powder having a particle size within this range is used, the magnetic powder can be easily homogeneously dispersed in the binder resin.

The average particle size of the magnetic powder can be measured by using an image obtained by enlarging, by 4 times, a microphotograph taken with a magnification power of 10,000 by using a scanning electron microscope. Specifically, arbitrary 300 magnetic powder particles are measured for Martin's diameters (equivalent circle diameters) in an electron microphotograph, and an average of the Martin's diameters of the 300 magnetic powder particles is calculated to obtain the average particle size of the magnetic powder. The particle size of the magnetic powder can be adjusted by changing production conditions in accordance with a known method. If a magnetic powder of magnetite is to be prepared, the particle size of the magnetic powder can be adjusted by adjusting the time of the oxidation reaction performed in producing the magnetic powder by the aforementioned production method.

The magnetic powder may be surface treated with a coupling agent (such as a titanium coupling agent or a silane coupling agent) for purpose of improving the dispersibility of the magnetic powder in the binder resin.

The content of the magnetic powder in the toner particles of the toner of the present disclosure is preferably 30% by mass or more and 60% by mass or less, and more preferably 35% by mass or more and 55% by mass or less based on the whole mass of the toner. A toner including toner particles containing the magnetic powder in a content of 30% by mass or more and 60% by mass or less can be stably charged to a desired charge amount in both a low-temperature and low-humidity environment and a high-temperature and high-humidity environment. Therefore, when the toner including the toner particles containing the magnetic powder in a content within the preferable range mentioned above is used, an image can be formed in a desired image density and the occurrence of an image defect (such as fogging) can be suppressed in a formed image in both a low-temperature and low-humidity environment and a high-temperature and high-humidity environment.

[Release Agent]

The toner of the present disclosure may contain a release agent if necessary. A release agent is used generally for purpose of improving the fixability or the offset resistance of a toner. The type of release agent is not especially limited as long as it is generally used as a release agent for a toner.

Preferable examples of the release agent include aliphatic hydrocarbon waxes (such as low molecular weight polyethylene, low molecular weight polypropylene, polyolefin copolymers, polyolefin wax, microcrystalline wax, paraffin wax and Fischer-Tropsch wax), oxides of the aliphatic hydrocarbon waxes (such as polyethylene oxide wax and a block copolymer of polyethylene oxide wax), vegetable waxes (such as candelilla wax, carnauba wax, haze wax, jojoba wax and rice wax), animal waxes (such as beeswax, lanolin and spermaceti wax), mineral waxes (such as ozokerite, ceresin and petrolatum), waxes containing a fatty acid ester as a principal component (such as montanic acid ester wax and castor wax), and waxes obtained by deoxidizing part or whole of fatty acid ester (such as deoxidized carnauba wax).

The amount of use of the release agent to be used is preferably 2% by mass or more and 10% by mass or less based on the whole mass of the toner. If the amount of the release agent is excessively small, a desired effect to suppress occurrence of an offset or image smearing in a formed image cannot be attained in some cases. If the amount of use of the release agent is excessively large, toner particles are fused with each other to degrade the storage stability of the toner in some cases.

[Coloring Agent]

The color of the toner particles included in the toner of the present disclosure is generally black because the magnetic powder is contained as the indispensable component. Therefore, each of the toner particles may contain, as a coloring agent, any of known dyes and pigments for purpose of adjusting an image, formed by using the magnetic one-component developing toner of the present disclosure, to have more preferable black hue. Specifically, an example of the pigment includes carbon black. An example of the dye includes acid violet.

The amount of the coloring agent to be used is preferably 1% by mass or more and 20% by mass or less, and more preferably 1% by mass or more and 10% by mass or less based on the mass of the toner.

[Charge Control Agent]

In the toner of the present disclosure, a charge control agent may be contained in the binder resin. A charge control agent is used for purpose of improving the stability in charge level of a toner or the charge rising property of the toner, so as to obtain a toner excellent in the durability or the stability. The charge rising property is an index whether or not the toner can be charged to predetermined charge level in a short period of time. If development is performed with the toner positively charged, a positively chargeable charge control agent is used. If the development is performed with the toner negatively charged, a negatively chargeable charge control agent is used.

Specific examples of the positively chargeable charge control agent include azine compounds (such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline and quinoxaline), direct dyes made of an azine compound (such as azine fast red FC, azine fast red 12BK, azine violet BO, azine brown 3G, azine light brown GR, azine dark green BH/C, azine deep black EW, and azine deep black 3RL), nigrosine compounds (such as nigrosine, nigrosine salts and nigrosine derivatives), acidic dyes made of a nigrosine compound (such as nigrosine BK, nigrosine NB and nigrosine Z), metal salts of naphthenic acid or higher fatty acid, alkoxylated amine, alkyl amide, and quaternary ammonium salts (such as benzylmethylhexyldecyl ammonium and decyl trimethyl ammonium chloride). Among these positively chargeable charge control agents, nigrosine compounds are particularly preferably used because a rapider charge rising property can be attained by them. Two or more of these positively chargeable charge control agents may be used in combination.

A resin having, as a functional group, a quaternary ammonium salt, a carboxylate or a carboxyl group can be used as the positively chargeable charge control agent. Specific examples of such a resin include styrene resins having a quaternary ammonium salt, acrylic resins having a quaternary ammonium salt, styrene acrylic resins having a quaternary ammonium salt, polyester resins having a quaternary ammonium salt, styrene resins having a carboxylate, acrylic resins having a carboxylate, styrene acrylic resins having a carboxylate, polyester resins having a carboxylate, styrene resins having a carboxyl group, acrylic resins having a carboxyl group, styrene acrylic resins having a carboxyl group, and polyester resins having a carboxyl group. The molecular weight of such a resin is not especially limited, and the resin may be an oligomer or a polymer.

Specific examples of the negatively chargeable charge control agent include organic metal complexes and chelate compounds. As the organic metal complexes and the chelate compounds, acetylacetone metal complexes (such as aluminum acetyl acetonate and iron (II) acetyl acetonate), salicylic acid metal complexes and salicylic acid metal salts (such as chromium 3,5-di-tert-butylsalicylate) are preferably used, and the salicylic acid metal complexes and salicylic acid metal salts are more preferably used. Two or more of these negatively chargeable charge control agents may be used in combination.

The amount of the positively chargeable or negatively chargeable charge control agent is preferably 1.5% by mass or more and 15% by mass or less, more preferably 2.0% by mass or more and 8.0% by mass or less, and particularly preferably 3.0% by mass or more and 7.0% by mass or less based on the mass of the toner.

[External Additive]

The surface of each of the toner particles included in the toner may be treated with an external additive if necessary. Herein, a toner particle prior to the treatment with an external additive is designated as a "toner mother particle". The external additive may be appropriately selected from those generally used for toners. Specific examples of a suitably used external additive include silica and metal oxides (such as alumina, titanium oxide, magnesium oxide, zinc oxide, strontium titanate and barium titanate). Two or more of these external additives may be used in combination.

The particle size of the external additive is preferably 0.01 μm or more and 1.0 μm or less.

The amount of the external additive to be used is preferably 0.1 parts by mass or more and 10 parts by mass or less, and more preferably 0.2 parts by mass or more and 5 parts by mass or less based on 100 parts by mass of the toner mother particle.

[Method for Producing Positively Chargeable Magnetic Toner]

Now, a method for producing the toner of the present disclosure will be described. The production method for the toner can be appropriately selected from generally known toner production methods. In a suitable production method, a mixture of a binder resin and a magnetic powder, and an optional component (such as a coloring agent, a release agent or a charge control agent) if necessary, are mixed by using a mixer, the thus obtained mixture is melt kneaded, and the resulting melt kneaded product is pulverized and classified. A melt-kneader used in the production of the toner mother particle is not especially limited, but may be appropriately selected from apparatuses used for melt kneading of thermoplastic resins. A specific example of the melt-kneader includes a single screw or twin screw extruder. The average particle size of the toner is preferably 5 μm or more and 10 μm or less in general.

The surface of each toner particle included in the toner thus obtained may be treated with an external additive if necessary. A method for treating the toner with an external additive is not especially limited, but may be appropriately selected from known treatment methods using external additives. Specifically, the treatment with an external additive is performed by using a mixer (such as a Henschel mixer or a Nauta mixer) under treatment conditions adjusted so that a particle of the external additive cannot be embedded in a toner particle.

The toner of the present disclosure described so far is excellent in fixability and can form an image having a desired image density and suppress the occurrence of an image defect (such as fogging in a formed image) no matter whether image formation is performed in both a low-temperature and low-humidity environment and a high-temperature and high-humidity environment. Accordingly, the toner of the present disclosure can be suitably used in a variety of image forming apparatuses.

EXAMPLES

The present disclosure will now be described more specifically with reference to examples. It is noted that the present disclosure is not limited to the scopes of these examples.

Preparation Example 1

Preparation of Polyester Resins A to E

A four-necked flask with a volume of 2 L equipped with a thermometer, a stainless steel stirrer, a nitrogen introducing glass tube and a flow-down type condenser was used as a reaction vessel. Monomers in a total amount of 500 g were put in the reaction vessel in a ratio as shown in Table 1. The reaction vessel was placed on a mantle heater, and a nitrogen gas was introduced into the reaction vessel through the nitrogen introducing glass tube, so as to establish an inert atmosphere within the reaction vessel. Subsequently, with stirring the mixture of the monomers, the temperature within the reaction vessel was increased to 240° C., and a polymerization reaction was performed at 240° C. with continuously stirring. During the polymerization reaction, a small amount of a resin produced in the reaction vessel was collected to measure its acid value, so that the polymerization reaction could be stopped when the acid value reached a value shown in Table 1. The resultant content of the reaction vessel was taken out to a stainless steel vat to cool to room temperature. In this manner, each of polyester resins A to E was prepared.

TABLE 1

| Polyester resin | A | B | C | D | E |
|---|---|---|---|---|---|
| Ethylene glycol [mol %] | 56 | 52 | 57 | 51 | — |
| Propylene glycol [mol %] | — | — | — | — | 54 |
| Terephthalic acid [mol %] | 39 | 43 | 38 | 44 | — |
| Isophthalic acid [mol %] | — | — | — | — | 41 |
| 1,2,4-benzenetricarboxylic anhydride [mol %] | 5 | 5 | 5 | 5 | 5 |
| Acid value [mgKOH/g] | 10 | 16 | 8 | 18 | 12 |

Preparation Example 2

Preparation of Magnetic Powder (Magnetic powders A to C)

Each of magnetic powders A to C was prepared as follows:

First, 50 L of a ferrous sulfate aqueous solution containing 2.0 mol/L of $Fe^{2+}$ and 40.0 L of a 5.0 mol/L sodium hydroxide aqueous solution were mixed in a reaction vessel. The mixture thus obtained in the reaction vessel was heated to 90° C. to produce a ferrous salt suspension containing ferrous hydroxide colloid.

After adjusting the suspension to pH 10 at 90° C., an oxidation reaction was started by blowing air into the suspension at a rate of 20 L/min. After proceeding the oxidation reaction of the ferrous salt to a rate of reaction of 20%, a silicic acid aqueous solution obtained by dissolving silicic acid in an amount shown in Table 2 in 5 L of water was started to be added to the reaction vessel. The silicic acid aqueous solution was added at a rate of 2.5 L/hr. The oxidation reaction was continued over a predetermined time period under addition of the silicic acid aqueous solution, and thus, a slurry containing magnetite particles was obtained.

The magnetite particles were filtered out of the slurry containing the magnetite particles by a usual method. The filtered magnetite particles were washed, dried and pulverized, and thus, each of the magnetic powders A to C was obtained. Each of the magnetic powders A to C had an average particle size of approximately 0.2 μm and had an octahedral shape.

The average particle size of each magnetic powder (magnetite particles) was measured by using an image obtained by enlarging, by 4 times, a microphotograph taken with a magnification power of 10,000 by using a scanning electron microscope ("JSM-7600" manufactured by JEOL Ltd.). Specifically, arbitrary 300 magnetic powder particles were measured for Martin's diameters (equivalent circle diameters) in an electron microphotograph, and an average of the Martin's diameters of the 300 magnetic powder particles was calculated to obtain the average particle size of the magnetic powder.

The shape of the magnetic powder particle was checked by using a microphotograph taken (with a magnification power of 10,000 or more and 50,000 or less) by the above-described scanning electron microscope.

(Magnetic Powder D)

A magnetic powder D was prepared in the same manner as in the preparation of the magnetic powder A except that 5 L of a 2 mol/L sulfuric acid aqueous solution was used instead of the silicic acid aqueous solution obtained by dissolving 40 g of silicic acid in 5 L of water. The magnetic powder D had an average particle size of approximately 0.2 μm and had an octahedral shape.

(Magnetic powders E to G)

Each of magnetic powders E to G was prepared in the same manner as in the preparation of the magnetic powder A except that a titanic acid aqueous solution obtained by dissolving titanic acid in an amount shown in Table 2 in 5 L of water was used instead of the silicic acid aqueous solution obtained by dissolving 40 g of silicic acid in 5 L of water. Each of the magnetic powders E to G had an average particle size of approximately 0.2 μm and had an octahedral shape.

<<Measurement of Magnetic Characteristics>>

The thus obtained magnetic powders A to G were measured for their magnetic characteristics (such as coercive force, saturated magnetization and remanent magnetization) in an external magnetic field of 796 kA/m by using a vibrating sample magnetometer ("VSM-P7" manufactured by Toei Industry Co., Ltd.). The measurement results of the magnetic characteristics (the coercive force, saturated magnetization and remanent magnetization) are shown in Table 2.

<<Measurement of Water Absorption of Magnetic Powder>>

The obtained magnetic powders A to G were measured for a water absorption $AM_L$ shown in a low-temperature and low-humidity environment (specifically, at 10° C. and 20% RH) and a water absorption $AM_H$ shown in a high-temperature and high-humidity environment (specifically, at 28° C. and 80% RH) by methods described below. The measurement results of the water absorptions of the magnetic powders are shown in Table 2.

(Measurement of Water Absorption $AM_L$ of Magnetic Powder Shown in Low-Temperature and Low-Humidity Environment)

Each of the magnetic powders in an amount of 10 g was put in a weighing bottle having a known mass and opened upward, and the resultant weighing bottle was allowed to stand still together with dry silica gel in a desiccator in an environment of 25° C. for 48 hours. After the standing, a mass of the magnetic powder was measured, and the measured mass was regarded as a reference mass $WM_I$. Thereafter, the weighing bottle containing the magnetic powder, which had been measured for the mass $WM_I$, was allowed to stand still in a low-temperature and low-humidity environment of 10° C. and 20% RH for 48 hours. After standing in the low-temperature and low-humidity environment, a mass $WM_L$ of the magnetic powder was measured. On the basis of the mass $WM_I$ and the mass $WM_L$, the water absorption $AM_L$ of the magnetic powder shown in the low-temperature and low-humidity environment was calculated in accordance with the following formula:

$$AM_L[\text{mass }\%]=((WM_L-WM_I)/WM_I)\times 100$$

(Measurement of Water Absorption $AM_H$ of Magnetic Powder Shown in High-Temperature and High-Humidity Environment)

A mass $WM_H$ of each magnetic powder obtained after standing in a high-temperature and high-humidity environment for 48 hours was measured in the same manner as in the measurement of the water absorption $AM_L$ except that an environment for standing after the measurement of the mass $WM_I$ was changed from the low-temperature and low-humidity environment of 10° C. and 20% RH to a high-temperature and high-humidity environment of 28° C. and 80% RH. On the basis of the mass $WM_I$ and the thus obtained mass $WM_H$, the water absorption $AM_H$ of the magnetic powder shown in the high-temperature and high-humidity environment was calculated in accordance with the following formula:

$$AM_H[\text{mass }\%]=((WM_H-WM_1)/WM_1)\times 100$$

TABLE 2

| | Magnetic powder | | | | | | |
|---|---|---|---|---|---|---|---|
| | A | B | C | D | E | F | G |
| Silicic acid [g] | 40 | 50 | 30 | — | — | — | — |
| Sulfuric acid aqueous solution [mol/l] | — | — | — | 2 | — | — | — |
| Titanic acid [g] | — | — | — | — | 40 | 50 | 30 |
| Magnetic characteristics | | | | | | | |
| Coercive force [kA/m] | 8.5 | 8.2 | 8.7 | 8.9 | 8.6 | 8.3 | 8.8 |
| Saturated magnetization [$Am^2/kg$] | 82 | 80 | 83 | 84 | 81 | 79 | 83 |
| Remanent magnetization [$Am^2/kg$] | 5.0 | 4.7 | 5.2 | 5.3 | 4.9 | 4.7 | 5.1 |
| Water absorption | | | | | | | |
| Water absorption ($AM_L$) in environment of 10° C./20% RH [mass %] | 0.08 | 0.09 | 0.06 | 0.05 | 0.10 | 0.11 | 0.09 |
| Water absorption ($AM_H$) in environment of 28° C./80% RH [mass %] | 0.25 | 0.28 | 0.22 | 0.29 | 0.23 | 0.25 | 0.21 |

Examples 1 to 8 and Comparative Examples 1 to 7

Positively chargeable magnetic toners of Examples 1 to 8 and Comparative Examples 1 to 7 were produced by using magnetic powders respectively of types and in amounts shown in Tables 3 and 4. Specifically, each toner was prepared as follows:

Forty-five parts by mass of a polyester resin of a type shown in Table 3 or 4, 5 parts by mass of a positively chargeable charge control agent ("FCA-207P" manufactured by Fujikura Kasei Co., Ltd.), a magnetic powder of a type and in an amount shown in Table 3 or 4, and 5 parts by mass of a release agent ("WEP-7" manufactured by NOF Corporation) were mixed by using a Henschel mixer ("FM-20" manufactured by Nippon Coke & Engineering Co., Ltd.) for 4 minutes at a rotational speed of 2000 rpm. The thus obtained mixture was melt kneaded by using a twin screw extruder ("PCM-30" manufactured by Ikegai Corporation) under conditions of a melt kneading temperature (a cylinder temperature) of 120° C., a rotational speed of 150 rpm and a throughput speed of 100 g/min. The resulting melt kneaded product was roughly pulverized into an average particle size of approximately 2 mm by using a rotoplex pulverizer (manufactured by Alpine). Subsequently, the roughly pulverized product was finely pulverized by using a mechanical pulverizer ("Turbo Mill T250" manufactured by Freund-Turbo Corporation). The thus obtained finely pulverized product was classified by using an air classifier ("EJ-L3" manufactured by Nittetsu Mining Co., Ltd.) to give toner mother particles with an average particle size of 8 μm.

A hundred parts by mass of the thus obtained toner mother particles, 0.8 parts by mass of silica fine particles ("RA200" manufactured by Nippon Aerosil Co., Ltd.) and 0.8 parts by mass of titanium oxide fine particles ("EC100" manufactured by Titan Kogyo Ltd.) were mixed by using a Henschel mixer under conditions of a rotational speed of 2000 rpm for 5 minutes, and thus, a toner of each of Examples 1 to 8 and Comparative Examples 1 to 7 was produced.

<<Measurement of Water Absorption of Toner>>

Each of the toners of Examples 1 to 8 and Comparative Examples 1 to 7 was measured for the water absorption $AT_L$ shown in a low-temperature and low-humidity environment (of 10° C. and 20% RH) and the water absorption $AT_H$ shown in a high-temperature and high-humidity environment (of 28° C. and 80% RH) by methods described below. The measurement results of the water absorptions of the toners are shown in Tables 3 to 6.

(Measurement of Water Absorption $AT_L$ of Toner Shown in Low-Temperature and Low-Humidity Environment)

Each of the toners in an amount of 10 g was put in a weighing bottle having a known mass and opened upward, and the resultant weighing bottle was allowed to stand still together with dry silica gel in a desiccator having an internal temperature of 25° C. for 48 hours. After the standing, a mass of the toner was measured, and the measured mass was regarded as a reference mass $WT_I$. Thereafter, the weighing bottle containing the toner, which had been measured for the mass $WT_I$, was allowed to stand still in a low-temperature and low-humidity environment of 10° C. and 20% RH for 48 hours. After standing in the low-temperature and low-humidity environment, a mass $WT_L$ of the toner was measured. On the basis of the mass $WT_I$ and the mass $WT_L$, the water absorption $AT_L$ of the toner shown in the low-temperature and low-humidity environment was calculated in accordance with the following formula:

$$AT_L[\text{mass }\%]=((WT_L-WT_I)/WT_I)\times 100$$

(Measurement of Water Absorption $AT_H$ of Toner Shown in High-Temperature and High-Humidity Environment)

A mass $WT_H$ of each toner obtained after standing in a high-temperature and high-humidity environment for 48 hours was measured in the same manner as in the measurement of the mass $WT_L$ except that an environment for standing after the measurement of the mass $WT_I$ was changed from the low-temperature and low-humidity environment of 10° C. and 20% RH to a high-temperature and high-humidity environment of 28° C. and 80% RH. On the basis of the mass $WT_I$ and the thus obtained mass $WT_H$, the water absorption $AT_H$ of the toner shown in the high-temperature and high-humidity environment was calculated in accordance with the following formula:

$$AT_H[\text{mass }\%]=((WT_H-WT_1)/WT_I)\times 100$$

<<Evaluation>>

Each of the toners of Examples 1 to 8 and Comparative Examples 1 to 7 was used for evaluating the fixability, an image density and a fogging density attained in a high-temperature and high-humidity environment, and an image density and a fogging density attained in a low-temperature and low-humidity environment. The evaluation was performed by using, as an evaluation apparatus, a printer ("FS-1370DN" manufactured by Kyocera Document Solutions Inc.) with 130 g of each of the toners of Examples 1 to 8 and Comparative Examples 1 to 7 filled in a developing unit provided in the printer.

<Evaluation of Fixability>

A solid image for evaluation with a size of 2.5 cm×2.5 cm was output onto a recording medium by using the printer in an environment of 20° C. and 60% RH. After lightly adhering a mending tape ("No. 810-3-12" manufactured by Sumitomo 3M Ltd.) onto a part of the solid image, the solid image was rubbed via the mending tape through 5 reciprocating motions by using a weight (having a bottom in the shape of a square of 4 cm×4 cm) at a pressure of 30 gf/cm$^2$. Thereafter, the mending tape was peeled off with an angle between the recording medium and the mending tape set to approximately 90°. A portion of the solid image from which the mending tape had been peeled off was visually observed, and the fixability was determined based on the following criteria:

G (good): It was observed that the recording medium was not exposed in the solid image.

P (poor): It was observed that the recording medium was exposed in the solid image.

<Evaluation of Image Density and Fogging Density>

(Evaluation of Densities Attained in High-Temperature and High-Humidity Environment)

In an image formed in a high-temperature and high-humidity environment (of 28° C. and 80% RH), an image density and a fogging density were measured by a method described below. The measurement results are shown in Tables 3 to 6. The image density and the fogging density were measured by using a reflection densitometer ("TC-6DS" manufactured by Tokyo Denshoku Co., Ltd.). An image for the evaluation was formed as follows:

First, the printer and the developing unit filled with a toner were allowed to stand still for 48 hours in an environment of 28° C. and 80% RH. Thereafter, the developing unit was set in the printer, so as to continuously output 2,000 copies of an image with a coverage rate of 1% formed on a recording medium. After that, a solid image with a size of 2.5 cm×2.5 cm to be used for evaluating an image density and a white image to be used for evaluating a fogging density were respectively output onto recording media.

An image density of a substantially center portion of the solid image was determined, as the image density attained by the toner, based on the following criteria:

G (good): The image density was 1.1 or more.

P (poor): The image density was lower than 1.1.

By using a value (which value corresponds to a fogging density) obtained by subtracting an image density of white paper obtained before outputting an image from an image density of the white image, the fogging density attained by the toner was determined based on the following criteria:

G (good): The fogging density was 0.010 or lower.

P (poor): The fogging density exceeded 0.010.

(Evaluation of Densities Attained in Low-Temperature and Low-Humidity Environment)

An image density and a fogging density were evaluated in the same manner as the evaluation of these densities attained in the high-temperature and high-humidity environment except that the environment of the standing of the printer and the developing unit filled with a toner was changed from the high-temperature and high-humidity environment (of 28° C. and 80% RH) to a low-temperature and low-humidity environment (of 10° C. and 20% RH).

TABLE 3

| | Example | | | |
|---|---|---|---|---|
| | 1 | 2 | 3 | 4 |
| Binder resin | | | | |
| Type | A | B | A | E |
| Acid value [mgKOH/g] | 10 | 16 | 10 | 12 |
| Magnetic powder | | | | |
| Type | A | A | E | A |
| Water absorption [mass %] $AM_L$ | 0.08 | 0.08 | 0.10 | 0.08 |
| Water absorption [mass %] $AM_H$ | 0.25 | 0.25 | 0.23 | 0.25 |
| Amount [parts by mass] | 45 | 45 | 45 | 45 |
| Water absorption of toner [mass %] | | | | |
| $AT_L$ | 0.03 | 0.07 | 0.03 | 0.05 |
| $AT_H$ | 0.27 | 0.34 | 0.27 | 0.30 |
| Evaluation | | | | |
| Fixability | G | G | G | G |
| Environment of 10° C. and 20% RH | | | | |
| Image density | 1.28 | 1.22 | 1.26 | 1.24 |
| Determination | G | G | G | G |
| Fogging density | 0.007 | 0.004 | 0.006 | 0.005 |
| Determination | G | G | G | G |
| Environment of 28° C. and 80% RH | | | | |
| Image density | 1.20 | 1.13 | 1.23 | 1.16 |
| Determination | G | G | G | G |
| Fogging density | 0.005 | 0.003 | 0.005 | 0.003 |
| Determination | G | G | G | G |

TABLE 4

| | Example | | | |
|---|---|---|---|---|
| | 5 | 6 | 7 | 8 |
| Binder resin | | | | |
| Type | A | A | A | A |
| Acid value [mgKOH/g] | 10 | 10 | 10 | 10 |
| Magnetic powder | | | | |
| Type | F | G | A | A |
| Water absorption [mass %] $AM_L$ | 0.11 | 0.09 | 0.08 | 0.08 |
| Water absorption [mass %] $AM_H$ | 0.25 | 0.21 | 0.25 | 0.25 |
| Amount [parts by mass] | 45 | 45 | 40 | 50 |
| Water absorption of toner [mass %] | | | | |
| $AT_L$ | 0.03 | 0.03 | 0.03 | 0.03 |
| $AT_H$ | 0.27 | 0.27 | 0.27 | 0.27 |
| Evaluation | | | | |
| Fixability | G | G | G | G |
| Environment of 10° C. | | | | |

TABLE 4-continued

| | Example | | | |
|---|---|---|---|---|
| | 5 | 6 | 7 | 8 |
| and 20% RH | | | | |
| Image density | 1.26 | 1.27 | 1.30 | 1.22 |
| Determination | G | G | G | G |
| Fogging density | 0.005 | 0.006 | 0.008 | 0.004 |
| Determination | G | G | G | G |
| Environment of 28° C. and 80% RH | | | | |
| Image density | 1.21 | 1.24 | 1.26 | 1.18 |
| Determination | G | G | G | G |
| Fogging density | 0.004 | 0.006 | 0.008 | 0.002 |
| Determination | G | G | G | G |

TABLE 5

| | Comparative Example | | | | |
|---|---|---|---|---|---|
| | 1 | 2 | 3 | 4 | 5 |
| Binder resin | | | | | |
| Type | C | D | A | B | A |
| Acid value [mgKOH/g] | 8 | 18 | 10 | 16 | 10 |
| Magnetic powder | | | | | |
| Type | A | A | B | C | C |
| Water absorption [mass %] $AM_L$ | 0.08 | 0.08 | 0.09 | 0.06 | 0.06 |
| $AM_H$ | 0.25 | 0.25 | 0.28 | 0.22 | 0.22 |
| Amount [parts by mass] | 45 | 45 | 45 | 45 | 45 |
| Water absorption of toner [mass %] | | | | | |
| $AT_L$ | 0.03 | 0.08 | 0.03 | 0.07 | 0.03 |
| $AT_H$ | 0.25 | 0.36 | 0.27 | 0.34 | 0.27 |
| Evaluation | | | | | |
| Fixability | P | G | G | G | G |
| Environment of 10° C. and 20% RH | | | | | |
| Image density | 1.27 | 1.22 | 1.25 | 1.23 | 1.29 |
| Determination | G | G | G | G | G |
| Fogging density | 0.008 | 0.004 | 0.005 | 0.011 | 0.014 |
| Determination | G | G | G | P | P |
| Environment of 28° C. and 80% RH | | | | | |
| Image density | 1.18 | 1.02 | 1.09 | 1.15 | 1.22 |
| Determination | G | P | P | G | G |
| Fogging density | 0.005 | 0.002 | 0.003 | 0.004 | 0.006 |
| Determination | G | G | G | G | G |

TABLE 6

| | Comparative Example | |
|---|---|---|
| | 6 | 7 |
| Binder resin | | |
| Type | B | A |
| Acid value [mgKOH/g] | 16 | 10 |
| Magnetic powder | | |
| Type | B | D |
| Water absorption [mass %] $AM_L$ | 0.09 | 0.05 |
| $AM_H$ | 0.28 | 0.29 |
| Amount [parts by mass] | 45 | 45 |
| Water absorption of toner [mass %] | | |
| $AT_L$ | 0.07 | 0.03 |
| $AT_H$ | 0.34 | 0.27 |
| Evaluation | | |
| Fixability | G | G |
| Environment of 10° C. and 20% RH | | |
| Image density | 1.21 | 1.28 |
| Determination | G | G |
| Fogging density | 0.004 | 0.016 |
| Determination | G | P |
| Environment of 28° C. and 80% RH | | |
| Image density | 1.07 | 1.08 |
| Determination | P | P |
| Fogging density | 0.002 | 0.002 |
| Determination | G | G |

The toner of each of Examples 1 to 8 includes the toner particles each of which contains the binder resin including a polyester resin and the magnetic powder having the water absorption $AM_L$ and the water absorption $AM_H$ respectively falling in the predetermined ranges, and has the water absorption $AT_L$ and the water absorption $AT_H$ respectively within the predetermined ranges. It is understood, from the evaluation results, that such a toner has excellent fixability, can form an image having a desired image density and can suppress an image defect such as fogging in a formed image in both a low-temperature and low-humidity environment and a high-temperature and high-humidity environment.

The toner of Comparative Example 1 has an excessively low water absorption $AT_H$. It is understood that such a toner is poor in the fixability on a recording medium. It is also understood, from the evaluation results of Comparative Example 2, that a toner having excessively high water absorptions $AT_L$ and $AT_H$ is difficult to form an image having a desired image density in a high-temperature and high-humidity environment. This is probably because the charge state of the toner can be easily made unstable in a high-temperature and high-humidity environment.

The toner of each of Comparative Examples 4, 5 and 7 includes toner particles each containing a magnetic powder having an excessively low water absorption $AM_L$. It is understood, from the evaluation results, that if such a toner is used for forming an image, an image defect such as fogging can be easily caused in an image formed in a low-temperature and low-humidity environment. This is probably because layer turbulence is caused on a developing roller due to excessive charge, in a low-temperature and low-humidity environment, of the toner particles containing the magnetic powder having an excessively low water absorption $AM_L$. The toner of each of Comparative Examples 3, 6 and 7 includes toner particles each containing a magnetic powder having an excessively high water absorption $AM_H$. It is understood, from the evaluation results, that if such a toner is used for forming an image, it is difficult to form an image having a desired image density in a high-temperature and high-humidity environment. This is probably because it is difficult to charge the toner particles containing the magnetic powder having an excessively high water absorption $AM_H$ to a desired charge amount in a high-temperature and high-humidity environment.

What is claimed is:

1. A magnetic one-component developing toner comprising a plurality of toner particles, wherein each of the plurality of toner particles containing a binder resin and a magnetic powder dispersed in the binder resin, the binder resin including a polyester resin, where a mass of the toner measured after standing in a desiccator together with a desiccant in an environment of 25° C. for 48 hours is indicated as $WT_I$, a mass of the toner, having been measured for the mass $WT_I$, measured after standing in an environment of 10° C. and 20% RH for 48 hours is indicated as $WT_L$, and a mass of the toner, having been measured for the mass $WT_L$ measured after standing in an environment of 28° C. and 80% RH for 48 hours is indicated as $WT_H$, a water absorption $AT_L$ of the toner obtained in accordance with the following formula (1) is 0.07% by mass or less:

$$AT_L=((WT_L-WT_I)/WT_I)\times 100 \quad (1) \text{ and}$$

a water absorption $AT_H$ of the toner obtained in accordance with the following formula (2) is 0.27% by mass or more and 0.34% by mass or less:

$$AT_H=((WT_H-WT_I)/WT_I)\times 100 \quad (2), \text{ and}$$

where a mass of the magnetic powder measured after standing in a desiccator together with a desiccant in an environment of 25° C. for 48 hours is indicated as $WM_I$, that a mass of the magnetic powder, having been measured for the mass $WM_I$, measured after standing in an environment of 10° C. and 20% RH for 48 hours is indicated as $WM_L$, and a mass of the magnetic powder, having been measured for the mass $WM_I$, measured after standing in an environment of 28° C. and 80% RH for 48 hours is indicated as $WM_H$, a water absorption $AM_L$ of the magnetic powder obtained in accordance with the following formula (3) is 0.08% by mass or more:

$$AM_L=((WM_L-WM_I)/WM_I)\times 100 \quad (3), \text{ and}$$

a water absorption $AM_H$ of the magnetic powder obtained in accordance with the following formula (4) is 0.25% by mass or less:

$$AM_H=((WM_H-WM_I)/WM_I)\times 100 \quad (4).$$

2. A magnetic one-component developing toner according to claim 1, wherein the polyester resin has an acid value of 10 mgKOH/g or more and 16 mgKOH/g or less.

3. A magnetic one-component developing toner according to claim 1, wherein the polyester resin has a softening point of 80° C. or more and 150° C. or less.

4. A magnetic one-component developing toner according to claim 1, wherein the magnetic powder has an octahedral shape.

5. A magnetic one-component developing toner according to claim 1, wherein the polyester resin contains ethylene glycol or propylene glycol as a monomer.

6. A magnetic one-component developing toner according to claim 1, wherein a non-ferrous oxide is adhered to a surface of the magnetic powder.

* * * * *